US005343888A

United States Patent [19]

Stelzer

[11] Patent Number: 5,343,888

[45] Date of Patent: Sep. 6, 1994

[54] AUTOMATIC SYPHON SYSTEM

[76] Inventor: Ceil Stelzer, 606 S. Front St., Philadelphia, Pa. 19147

[21] Appl. No.: 37,556

[22] Filed: Mar. 26, 1993

[51] Int. Cl.[5] ..... F04F 10/00

[52] U.S. Cl. ..... 137/135; 137/151; 137/593

[58] Field of Search ..... 137/135, 151, 451, 593

[56] References Cited

U.S. PATENT DOCUMENTS

| | | | |
|---|---|---|---|
| 181,569 | 8/1876 | Field | 137/132 |
| 301,391 | 7/1894 | Reinecke | 137/135 |
| 317,505 | 5/1885 | Chaplin | 137/132 |
| 335,236 | 2/1886 | Parsons | 137/135 X |
| 374,726 | 12/1887 | Ayer | 137/135 |
| 1,025,608 | 5/1912 | Bliss | 137/135 |
| 1,068,995 | 7/1913 | Ferrero | 137/135 |
| 2,012,495 | 8/1935 | Bradbeer | 137/593 X |
| 3,822,715 | 7/1974 | Roa | 137/135 X |
| 3,996,960 | 12/1976 | Martinez-Lozano | 137/451 |
| 4,406,300 | 9/1983 | Wilson | 137/132 |
| 4,651,767 | 3/1987 | Mitchell | 137/132 |
| 4,798,222 | 1/1989 | Kauffman | 137/132 |
| 4,865,069 | 9/1989 | Lacey | 137/132 |

*Primary Examiner*—Gerald A. Michalsky

[57] ABSTRACT

A level activated syphon system which automatically begins drainage of a liquid such as water from an accumulation area such a swimming pool cover or flat roof when the accumulation of water reaches a preset level is disclosed. The system requires no outside source of energy and consists of a valve assembly at the accumulation area, a hose or pipe which serves as a conduit to the lower drainage area and a water seal at the lower drainage area. The valve is opened and closed by a float which rises and falls with the liquid level at the accumulation area and stops the liquid flow after the accumulation is lowered but does not allow air to enter the conduit. The liquid remains in the conduit to start the syphon cycle again when more liquid accumulates. The water seal prevents the liquid from draining from the conduit when the syphon action is stopped.

3 Claims, 2 Drawing Sheets

AUTOMATIC SYPHON SYSTEM

BACKGROUND OF THE INVENTION

1.) Field of the Invention

The present invention relates to an automatic syphon system, which will remove a liquid from a first area and displace the liquid to a second area which is at a lower height or elevation from the first area. This invention will automatically begin the syphon action as the liquid level in the first area rises to a predetermined depth and will automatically stop the syphon action when the liquid level in the first area is lowered to a predetermined depth because of the syphon action. This cycle will be repeated every time the liquid level rises in the first area. This invention does not require any outside source of energy such as electricity or water pressure but uses the energy of the rising water level and the weight of the liquid under the force of gravity between the first area and the second area to begin the syphon action.

2.) Description of the Prior Art

The principle of the syphon is a useful method to move a liquid from a first higher elevation to a second lower elevation, which uses the force of gravity to move the liquid in an enclosed or air tight conduit or pipe from the liquid at the first higher elevation to the second lower elevation. The conduit or pipe can follow any path of higher or lower elevations between the first higher elevation and the second lower elevation as long as the inlet to the conduit is submerged in the liquid and the outlet to the conduit is at the second lower elevation.

The syphon principle is used to move liquids from one container to another, to remove an accumulation of liquid such as water from the tops of swimming pool covers, flat roofs and building basements, and to flush areas where debris may collect such as drainage systems.

The differences between existing applications of the syphon relate mainly to the way that the syphon action is initiated and terminated. To initiate the syphon action, the conduit or pipe must be filled with liquid, and the flow from the inlet to the outlet of the conduit must be unrestricted. To terminate the syphon action, the conduit must be emptied of liquid or the flow must be restricted.

Examples of patents which use the rising level to fill the conduit are U.S. Pat. Nos. 4,865,069 and 4,798,222 They utilize a conduit with an inverted "U" at the inlet and a route of the conduit to the outlet which is of ever decreasing elevation. In this arrangement, the rising liquid level reaches the neck or top of the inverted "U" and fills the conduit to the discharge point which starts the syphon action. The syphon action continues until the level is lower than the inlet and air is admitted which displaces the liquid from the conduit. The disadvantage of this syphon system is that the level must rise to a height of the highest point of the conduit in the system. This does not allow the conduit to follow a path between the intake and discharge elevations which is higher than the elevation of the top of the inverted "U".

Examples of patents which use another accumulation or source of liquid to fill the conduit as the level at the inlet rises to a predetermined level are U.S. Pat. Nos. 4,406,300 and 4,651,767.

They utilize either reservoirs higher in elevation than the intake, which is filled with liquid as the intake area accumulates liquid or an independent source of liquid such as a pressurized water system. A level sensing means releases the liquid from the higher reservoir after a predetermined depth has been reached. The released liquid then fills the conduit to initiate the syphon action. Alternately, an independent source of liquid under pressure is released into the conduit to initiate the syphon action after a level sensing means detects a predetermined depth at the syphon intake.

The syphon action then continues until the level at the intake is lowered to a predetermined depth and air enters the conduit.

These devices require either auxiliary reservoirs with liquid release mechanisms, which can be complicated and unreliable or piping under pressure, which can be damaged by freezing temperatures, and require a source of pressurized liquid.

Examples of patents which restrict the flow to terminate the syphon action and unrestrict the flow to initiate the syphon action are Ser. No. 301,391 to Reinecke, U.S. Pat. No. 1,025,607 to Bliss, Ser. No. 335,236 to Parsons, Ser. No. 374,736 to Ayer, U.S. Pat. No. 1,068,995 to Ferroro, and U.S. Pat. No. 3,822,715 to Roa. They include automatic valve assemblies which restrict and unrestrict the inlet and/or the outlet of the syphon but have no provisions to prevent damage to the components of the system if the liquid freezes and expands, or to automatically restart the syphon action when temperatures rise above freezing.

SUMMARY OF THE INVENTION

The present invention provides a level activated syphon system to automatically start and stop syphon drainage from a higher intake area to a lower discharge area that is simple inexpensive and reliable, requires no outside source of energy such as electricity or water pressure, allows the route from the higher level to the lower level to pass over or under obstructions which may be higher or lower than the intake or discharge area and will be undamaged by freezing temperatures. The system consists of a liquid level sensing means or float at the intake which opens and closes a valve assembly at the intake as the liquid level rises and falls and a water seal at the discharge which prevents the liquid from draining from the interconnecting conduit between the intake and discharge when the syphon action is stopped at the inlet by the valve and allows sufficient liquid to remain in the conduit so that the syphon action will resume when the inlet valve is opened by the float.

The interaction between the liquid level sensing means or float and the valve at the inlet to the syphon conduit is such that as the liquid level rises to a predetermined point at the inlet the valve opens and when the liquid level drops to a predetermined point, the valve closes.

The components of the system can be fabricated from materials which have sufficient flexibility to expand and contract without damage as the liquid which is contained within them freezes and thaws. This allows the system to be used in freezing temperatures with the ability to automatically restart the syphon action when temperatures rise above freezing.

It is an object of this invention to provide a syphon drainage system which is automatic in operation and once put into service will repeatedly begin syphon drainage when a liquid level rises to a preset level and stop syphon drainage when a liquid level drops to a preset level. This cycle will repeat with no energy source needed, other than the rising level of the liquid.

It is an object of this invention to provide an automatic syphon drainage system which is reliable in operation and simple to maintain.

It is an object of this invention to provide an automatic syphon system wherein a minimum number of moving parts are utilized and manufacturing costs are minimized.

It is an object of this invention to provide an automatic syphon system which can be used in freezing temperatures with the ability to automatically restart the syphon action when the temperatures rise above freezing.

BRIEF DESCRIPTION OF THE DRAWINGS

While the invention is particularly described and distinctly claimed in the concluding sections herein, a preferred embodiment is set forth in the following detailed description which may be best understood when read in connection with the accompanying drawings in which:

DETAILED DESCRIPTION OF THE PREFERRED EMBODIMENT

Figure 1:
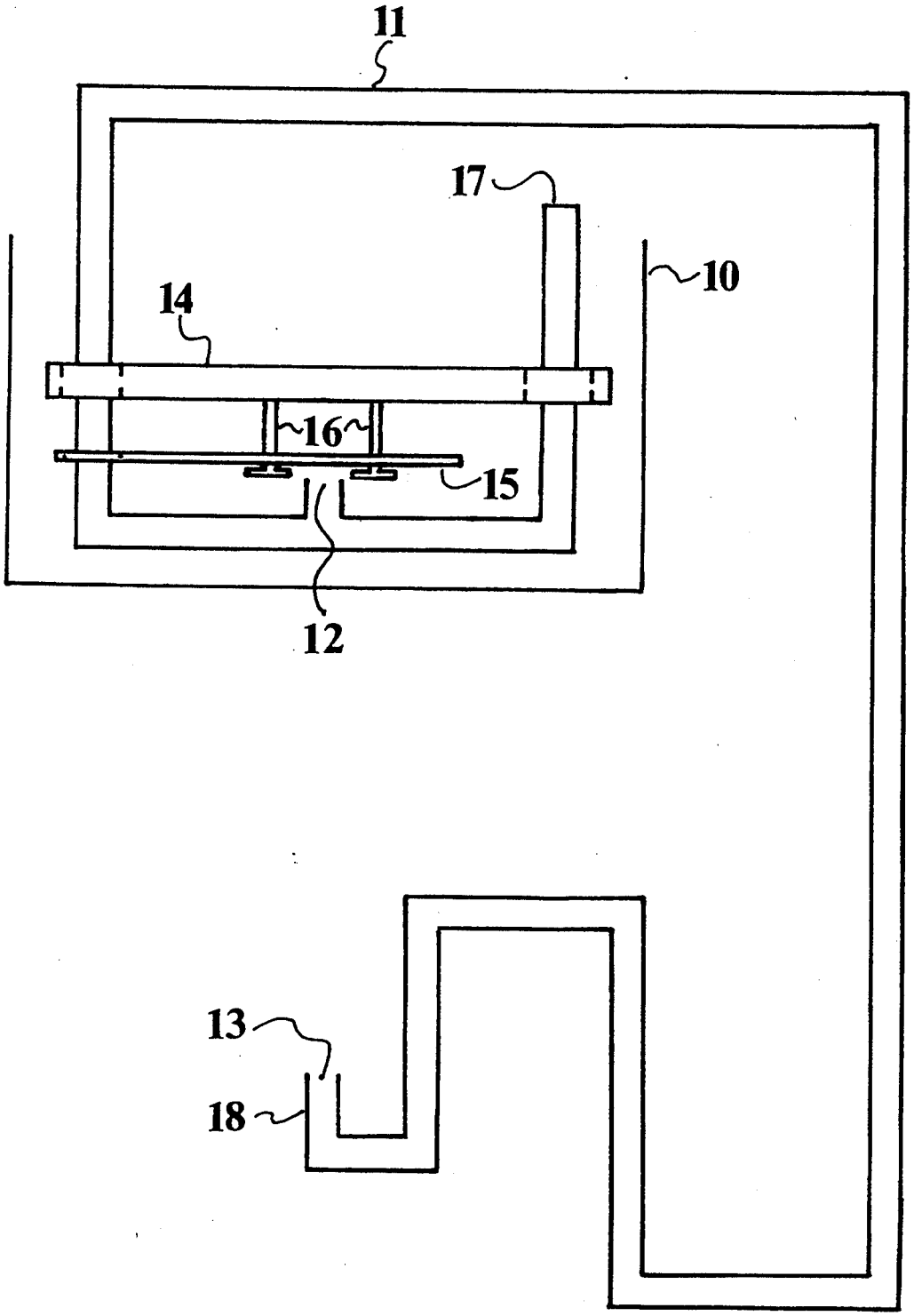
FIG. 1 is an elevation view of the syphon system showing: a first higher elevation, where the liquid to be moved is located; the conduit inlet, valve and float; the conduit between the first higher elevation and a second lower elevation with the water seal.

Referring to FIG. 1, there is shown a location defined by 10 where liquid accumulates and the automatic syphon system will maintain the liquid level at a predetermined level. Shown as 11 is the conduit which can be any cross sectional shape and is liquid and air tight and carries the liquid from the inlet 12 to the outlet 13 which is at a lower elevation than the inlet 12. The float is shown as 14 and consists of a material of a lower density than the liquid to be conveyed and will therefore float on the liquid and will rise and fall in conjunction with the liquid level. A liquid tight material is shown as 15, which is attached to the float by the attachment means 16. An end cap is shown as 17 and forms an air tight seal in the end of conduit 11.

Figure 2:
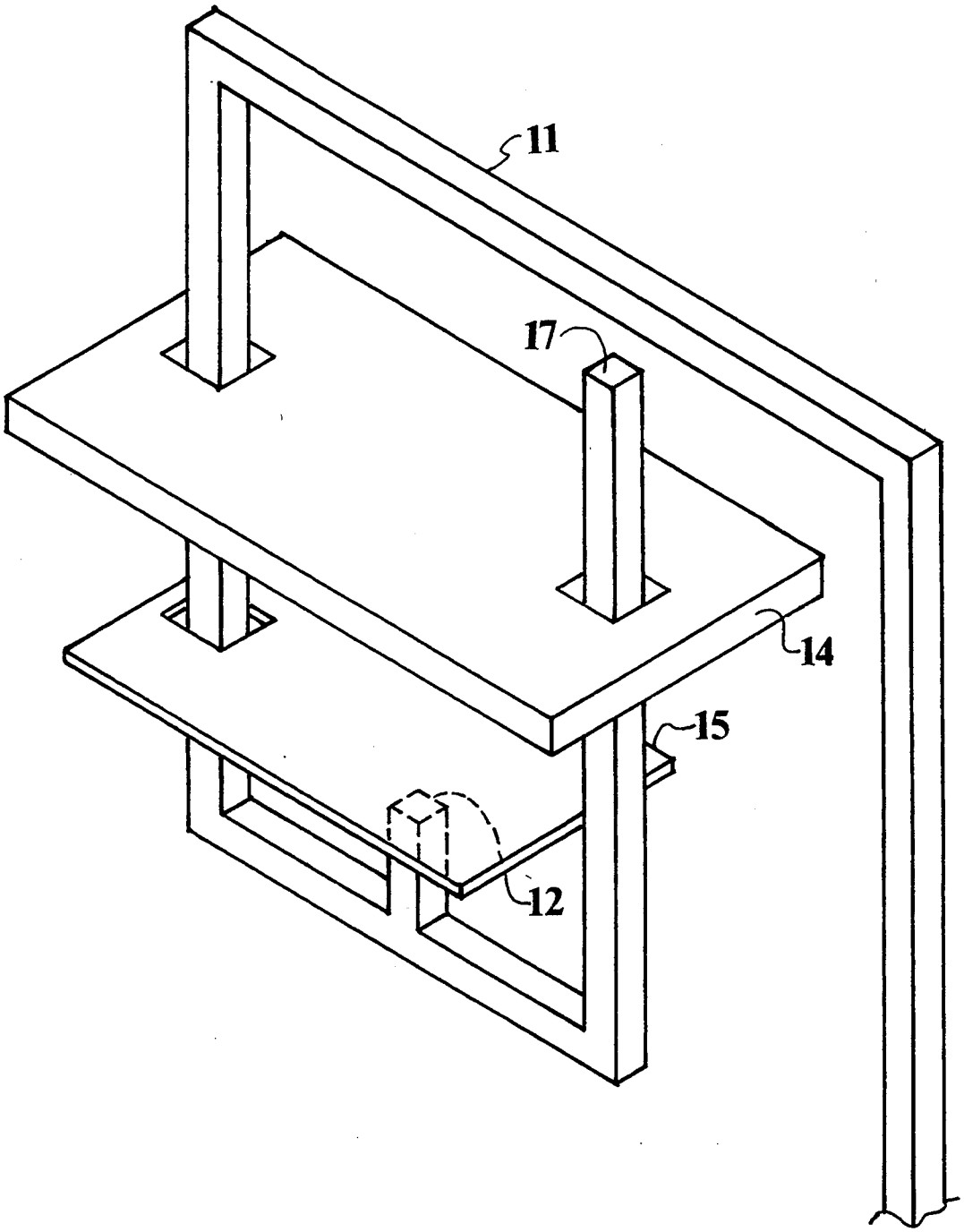
FIG. 2 is an isometric view of the inlet assembly of FIG. 1 not showing the attachment means between the float and the inlet seal material.

The operation of the syphon system requires the conduit 11 to be filled with liquid between the outlet 13 and the inlet 12. This can be easily accomplished by filling the conduit 11 from the outlet 13, using a source of pressurized liquid. The liquid admitted at the outlet 13 forces the air in the conduit to exit at the inlet 12 by lifting the liquid tight material 15 away from the inlet 12, When the conduit 11, between the inlet 12 and the outlet 13 is filled with liquid, and liquid begins to exit from the inlet 12, the liquid source is removed from 13. At this point the liquid in conduit 11 will begin to flow back toward the outlet, because of the difference in elevation between the inlet 12 and the outlet 13, but the liquid tight material 15 will cover the inlet 12 and stop the flow of liquid. At the outlet 13, a water seal is formed by the vertical Section 18 of the conduit, which does not allow the liquid to flow from the outlet 13 while the inlet 12 is covered by the liquid tight material 15. The system is now in automatic operation. As the liquid level rises at location 10, the float 14 will rise also. Because the liquid tight material 15 is connected to the float by attachment means 16, and because both the float 14 and the liquid tight material 15 have clearance in their openings around the conduit 11, the liquid tight material will also rise. With the density of the float 14 and the length of the attachment means 16 designed for the liquid to be removed, the inlet 12 will open only when there is liquid above the inlet. Once opened, the liquid will flow into the inlet 12 and out the outlet 13 because of the difference in elevation between them. As the liquid flows from location 10, the level will drop until the liquid tight material 15 covers and seals the inlet 12 and stops the flow of liquid. The cycle will then repeat itself indefinitely as liquid rises at location 10. The end cap 17 can be moved closer to the inlet 12 to the point where the conduit forms an "elbow" below the inlet 12. With the location of 17 as shown in FIG. 1 and 2, the conduit provides an additional support means for the float and allows a pocket of air in the conduit beyond the inlet to allow for expansion and contraction of the liquid.

In order to prevent the liquid from flowing from conduit 11 after the inlet 12 is closed, a water seal must be maintained at the outlet 13 which is located at a lower elevation than the inlet 12. The water seal prevents air from entering the conduit 11 at outlet 13 and displacing the liquid which would then leak from conduit 11, after the inlet 12 is closed. In FIG. 1 the vertical section 18 forms the water seal.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A level activated syphon system, which syphons liquid which accumulates at a first higher elevation to a second lower elevation, comprising: a liquid conduit having an inlet end and an outlet end, said inlet end having a valve assembly at the first higher elevation, said outlet end having a water seal assembly at the second lower elevation; a liquid level sensing means at the first higher elevation which closes said valve assembly when the liquid level is lowered to a predetermined point which will not allow air to enter said liquid conduit and displace liquid already contained within said liquid conduit between said inlet and said outlet end, and said liquid level sensing means which opens said value assembly when the liquid level is raised to a predetermined point, which opening of said valve assembly restarts the syphon action from the first higher elevation to the second lower elevation; said water seal assembly which allows liquid to flow from said outlet end when said valve assembly is opened and prevents liquid from flowing from said outlet end when said valve assembly is closed; an air tight seal at the end of the conduit which forms a pocket of air in the conduit beyond the inlet to allow for expansion and contraction of the liquid such as when the liquid freezes and thaws.

2. A level activated syphon system according to claim 1 in which the components of the systems are fabricated from materials which have sufficient flexibility to expand and contract without damage as the liquid in the system freezes and thaws.

3. A level activated syphon system according to claim 1 in which the conduit beyond the inlet provides an additional support means for the float.

* * * * *